US007718082B2

(12) United States Patent
Vidarsson et al.

(10) Patent No.: US 7,718,082 B2
(45) Date of Patent: May 18, 2010

(54) LUBRICANTS FOR INSULATED SOFT MAGNETIC IRON-BASED POWDER COMPOSITIONS

(75) Inventors: Hilmar Vidarsson, Höganäs (SE); Paul Skoglund, Höganäs (SE); Björn Skårman, Höganäs (SE)

(73) Assignee: Höganäs AB, Höganäs (SE)

( * ) Notice: Subject to any disclaimer, the term of this patent is extended or adjusted under 35 U.S.C. 154(b) by 632 days.

(21) Appl. No.: 11/628,638

(22) PCT Filed: Jun. 21, 2005

(86) PCT No.: PCT/SE2005/000977

§ 371 (c)(1),
(2), (4) Date: Dec. 6, 2006

(87) PCT Pub. No.: WO2006/001763

PCT Pub. Date: Jan. 5, 2006

(65) Prior Publication Data

US 2008/0019859 A1 Jan. 24, 2008

(30) Foreign Application Priority Data

Jun. 23, 2004 (SE) ..... 0401644

(51) Int. Cl.
*B22F 1/00* (2006.01)
*C22C 33/02* (2006.01)
*H01F 1/24* (2006.01)

(52) U.S. Cl. ..... 252/62.55; 252/62.53; 252/62.54; 148/104; 148/105

(58) Field of Classification Search ..... 252/62.54, 252/62.53; 148/104, 105
See application file for complete search history.

(56) References Cited

U.S. PATENT DOCUMENTS

| | | | | |
|---|---|---|---|---|
| 3,014,825 | A * | 12/1961 | Harendza-Harinxma | 148/104 |
| 3,728,110 | A | 4/1973 | Klar et al. | |
| 4,002,474 | A * | 1/1977 | Blachford | 419/36 |
| 5,135,566 | A | 8/1992 | Sakuranda et al. | |
| 5,368,630 | A | 11/1994 | Luk | |
| 5,976,215 | A | 11/1999 | Uenosono et al. | |
| 6,372,348 | B1 * | 4/2002 | Hanejko et al. | 428/407 |
| 6,537,389 | B1 | 3/2003 | Aichele et al. | |
| 6,679,935 | B2 | 1/2004 | Hammond | |
| 7,217,310 | B2 | 5/2007 | Yahagi et al. | |
| 2002/0037948 | A1 | 3/2002 | Hanejko et al. | |
| 2002/0108468 | A1 | 8/2002 | Uenosono | |

FOREIGN PATENT DOCUMENTS

| | | | |
|---|---|---|---|
| EP | 311407 | A1 | 4/1989 |
| GB | 1458961 | A | 12/1976 |
| TW | 234098 | | 11/1994 |
| WO | WO 2004/013067 | A2 | 2/2004 |
| WO | WO 2005/012566 | A1 | 11/2005 |

* cited by examiner

*Primary Examiner*—C. Melissa Koslow
(74) *Attorney, Agent, or Firm*—Buchanan Ingersoll & Rooney PC

(57) ABSTRACT

The invention concerns a powder metallurgical composition containing, preferably a coarse, soft magnetic iron or iron-based powder, wherein the particles are surrounded by an insulating inorganic coating and as lubricant at least one non-drying oil or liquid having a crystalline melting point below 25° C., a viscosity (η) at 40° C. above 15 mPas and wherein said viscosity is temperature dependent according to the following formula:

$$10 \log \eta = k/T + C$$

wherein the slope k is above 800
T is in Kelvin and
C is a constant
in an amount between 0.05 and 0.4% by weight of the composition.

14 Claims, No Drawings

LUBRICANTS FOR INSULATED SOFT MAGNETIC IRON-BASED POWDER COMPOSITIONS

FIELD OF THE INVENTION

This invention relates to lubricants for soft magnetic composites (SMC). Specifically, the invention concerns liquid lubricants for soft magnetic iron or iron-based powder wherein the particles are surrounded by an inorganic insulating layer.

BACKGROUND OF THE INVENTION

In industry, the use of metal products manufactured by compacting and heat-treating soft magnetic powder compositions is becoming increasingly widespread. A number of different products of varying shape and thickness are being produced, and different quality requirements are placed on these products depending on their final use. In order to meet the different requirements the powder metallurgy industry has developed a wide variety of iron and iron-based powder compositions.

One processing technique for producing the parts from these powder compositions is to charge the powder composition into a die cavity and compact the composition under high pressure. The resultant green part is then removed from the die cavity and heat-treated. To avoid excessive wear on the die cavity, lubricants are commonly used during the compaction process. Lubrication is generally accomplished by blending a solid, particular lubricant powder with the iron-based powder (internal lubrication) or by spraying a liquid dispersion or solution of the lubricant onto the die cavity surface (external lubrication). In some cases, both lubrication techniques are utilized.

Lubrication by means of blending a solid lubricant into the iron-based powder composition is widely used and new solid lubricants are developed continuously. These solid lubricants generally have a density of about 1-2 g/cm$^3$, which is very low in comparison with the density of the iron-based powder, which is about 7-8 g/cm$^3$. Additionally, in practice the solid lubricants have to be used in amounts of at least 0.6% by weight of the powder composition. As a consequence the inclusion of these less dense lubricants in the composition lowers the green density of the compacted part.

In modern PM technology, lubrication with only liquid lubricants has not been successful due to poor powder properties and handling. However, liquid lubricants have been suggested for use in combination with solid lubricants. Thus, the U.S. Pat. No. 6,537,389 discloses a method of manufacturing a soft magnetic composite material. In this method punching oil or rapeseed oil methyl ester are mentioned as examples of suitable lubricating additions in the powder composition to be compacted. These compounds are suggested to be used in combination with the solid stearic acid amide lubricant but nothing is taught about the physical nature of the punching oil or rapeseed oil methyl ester and no actual examples demonstrate the use of these compounds. The use of liquid lubricants is also known from U.S. Pat. No. 3,728,110 which teaches that the liquid lubricant should be used in combination with a porous silica gel. Also in this case the liquid lubricant should be combined with a solid lubricant.

It has now unexpectedly been found that when soft magnetic iron or iron-based powders of a certain type are combined with a specific type of liquid organic substances as lubricants, it will be possible to obtain compacted bodies having not only high density but it has also been found that these compacted bodies can be ejected from the dies with comparatively low ejection forces. Furthermore, it has turned out that these lubricants are effective in preventing wearing of the walls of the die and providing the compacted bodies an excellent surface finish. No silica gel is needed for the lubrication.

SUMMARY OF THE INVENTION

In brief the present invention concerns a powder composition including a soft magnetic iron or iron-based powder wherein the particles are surrounded by an inorganic insulating layer, and a liquid organic lubricant. The invention also concerns a method of preparing compacted and heat-treated parts by using the liquid lubricant.

DETAILED DESCRIPTION OF THE INVENTION

Powder Types

Suitable metal powders, which can be used as starting materials for the coating process, are powders prepared from ferromagnetic metals such as iron. Alloying elements such as nickel, cobolt, phosphorous, silicon, aluminum, chromium, boron, etc. can be added as particles or pre-alloyed in order to modify the properties of the iron-based product. The iron-based powders can be selected from the group consisting of substantially pure iron powders, pre-alloyed iron-based powders, and substantially pure iron or iron-based particles and alloying elements. As regards the particle shape, it is preferred that the particles have an irregular form as is obtained by water atomisation or sponge iron. Also gas-atomised powders and flakes may be of interest.

The size of the iron-based particles normally used within the PM industry is distributed according to a gaussian distribution curve with an average particle diameter in the region of 30 to 100 μm and about 10-30% of the particles are less than 45 μm. Thus, the powders used according to the present invention have a particle size distribution deviating from that normally used. These powders may be obtained by removing the finer fractions of the powder or by manufacturing a powder having the desired particle size distribution.

According to a preferred embodiment of the invention the powders should have coarse particles, i.e. the powders are essentially without fine particles. The term "essentially without fine particles" is intended to mean that less than about 10%, preferably less than 5% of the powder particles have a size below 45 μm s measured by the method described in SS-EN 24 497. The average particle diameter is typically between 106 and 425 μm (e.g., at least 40% by weight of the iron based powder consists of particles having a particle size above about 106 μm, and preferably at least 60% by weight of the iron based powder consists of particles having a particle size above about 106 μm). The amount of particles above 212 μm is typically above 20% (e.g., preferably at least 40% by weight of the iron based powder consists of particles having a particle size above about 212 μm, and preferably at least 50% by weight of the iron based powder consists of particles having a particle size above about 212 μm). The maximum particle size may be about 2 mm.

As regards SMC parts for high demanding applications, especially promising results have been obtained with water atomised iron powders wherein the particles are surrounded by an inorganic layer. Examples of powders within the scope of this invention are powders having the particle size distribution and chemical composition corresponding to Somaloy®550 and Somaloy®700 from Höganäs AB, Sweden.

Lubricant

The lubricant according to the present invention is distinguished by being liquid at ambient temperature, i.e. the crystalline melting point should be below 25° C. Another feature of the lubricant is that it is a non-drying oil or liquid.

Furthermore, the viscosity (η) at 40° C. should be above 15 mPa·s and depending of the temperature according to the following formula:

$$lg(\eta)=k/T+C,$$

wherein the slope k is preferably above 800 (T is in Kelvin and C is a constant).

A type of substances fulfilling the above criteria are non-drying oils or liquids, e.g. different mineral oils, vegetable or animal based fatty acids but also compounds such as polyethylene glycol, polypropylene glycol, glycerine, and esterified derivates thereof. These lubricating oils can be used in combination with certain additives, which could be referred to as "rheological modifiers", "extreme pressure additives", "anti cold welding additives", "oxidation inhibitors" and "rust inhibitors".

The lubricant can make up to 0.4% by weight (e.g., 0.05 to 0.40% by weight) of the metal-powder composition according to the invention. Preferably up to 0.3% by weight (e.g., 0.1 to 0.3% by weight). and most preferably up to 0.20% by weight or 0.25% by weight (e.g., 0.15 to 0.25% by weight) of the lubricant is included in the powder composition. The possibility of using the lubricant according to the present invention in very low amounts is especially advantageous since it permits that compacts and heat-treated products having high densities can be achieved especially as these lubricants need not be combined with a solid lubricant. However, the present invention does not exclude the addition of small amounts of solid (particulate) lubricant(s). It should be noted that the geometry of the component as well as the material and quality of the tool have great impact on the surface condition of the SMC parts after ejection. Therefore, may in certain cases the optimal content of lubricant be below 0.20% by weight. Additionally, and in contrast to the teaching in U.S. Patent No. 6,537,389, the iron powder particles are not coated with a thermoplastic compound.

The powder composition of the present invention may additionally contain one or more additives selected from the group consisting of organic binders and resins, flow-enhancing agents, processing aids and particulate lubricants.

Compaction

Conventional compaction at high pressures, i.e. pressures above about 600 MPa with conventionally used powders including finer particles, in admixture with low amounts of lubricants (less than 0.6% by weight) is generally considered unsuitable due to the high forces required in order to eject the compacts from the die, the accompanying high wear of the die and the fact that the surfaces of the components tend to be less shiny or deteriorated. By using the powders and liquid lubricants according to the present invention it has unexpectedly been found that the ejection force is reduced at high pressures, above about 600 MPa, and that components having acceptable or even perfect surfaces may be obtained also when die wall lubrication is not used. The compaction may be performed with standard equipment, which means that the new method may be performed without expensive investments. The compaction is performed uniaxially in a single step at ambient or elevated temperature. In order to reach the advantages with the present invention the compaction should preferably be performed to densities above 7.50 g/cm$^3$.

The invention is further illustrated by the following non-limiting examples.

As liquid lubricants, substances according to table 1 below were used;

TABLE 1

| Lubricant | Type | Trade name |
|---|---|---|
| A | Polyethylene glycol, $M_w$ 400 g/mol | PEG 400 (Clariant GmbH) |
| B | Distilled low-viscosity mineral oil | Spindle oil |
| C | Synthetic ester-based drawing oil | Nimbus 410 (Statoil ASA) |
| D | Oleoyl Sarcosine | Crodasinic O (Croda Chem. Ltd.) |
| E | Dimethyl-polysiloxan, viscosity (25° C.) 100 mPas | DMPS (Sigma-Aldrich) |
| F | 1,2,3 propantriol | Glycerine |

(Lubricants B and E are outside the scope of the invention.)

The following table 2 shows the viscosity at different temperatures of the liquid lubricants used;

TABLE 2

| | Viskosity η (mPa · s) | | | | | |
|---|---|---|---|---|---|---|
| T (° C.) | A | B | C | D | E | F |
| 30 | 73.0 | 10.7 | — | 2600 | 89.8 | 68.7 |
| 40 | 47.0 | 7.7 | 78.3 | 1100 | 74.6 | 40.3 |
| 50 | 32.0 | 5.9 | 53.0 | 600 | 62.8 | 25.5 |
| 60 | 23.0 | 4.9 | 39.0 | 400 | 53.5 | 17.3 |
| 70 | 17.5 | 4.0 | 30.4 | 130 | 45.6 | 12.9 |
| 80 | 13.5 | 3.4 | 23.1 | 85 | 39.5 | 8.8 |

The following table 3 discloses constants in the formula lg(η)=k/T+C (T in K) giving the temperature dependence of the viscosity of the liquid lubricants;

TABLE 3

| | A | B | C | D | E | F |
|---|---|---|---|---|---|---|
| k | 1563 | 1051 | 1441 | 3172 | 763 | 1875 |
| C | −3.316 | −2.462 | −2.725 | −7.050 | −0.565 | −4.375 |

Non-drying lubricating oils or liquids according to the invention shall have viscosity calculated according to the reported formula where the following requirement is met: k>800, and where the viscosity at 40° C. is >15 mPa·s. Hence, lubricants B and E, which are outside the scope of the invention, clearly demonstrate the effect of liquid lubricants which do not fulfil the requirements of the depicted formula.

EXAMPLE 1

Different iron-based powder compositions of totally 2 kg were prepared. The iron-based powder used was a soft magnetic powder, the particles of which had been provided with an insulating inorganic coating. The particle size distribution was as disclosed in "coarse powder" in table 4 below:

TABLE 4

| Particle size (μm) | Coarse powder (wt. %) | Fine powder (wt. %) |
|---|---|---|
| >425 | 0.1 | 0 |
| 425-212 | 64.2 | 0 |
| 212-150 | 34.0 | 11.2 |
| 150-106 | 1.1 | 25.0 |
| 106-75 | 0.3 | 22.8 |
| 45-75 | 0.2 | 26.7 |
| <45 | 0 | 14.3 |

400 grams of the iron-based powder was intensively mixed with 4.0 grams of liquid lubricants in a separate mixer, a so-called master mix was then obtained. The master mix was thereafter added to the remaining amount of soft magnetic iron-based powder and the final mix was mixed for further 3 minutes.

The obtained mixes were transferred to a die and compacted into cylindrical test samples (50 g), with a diameter of 25 mm, in a uniaxially press movement at a compaction pressure of 1100 MPa. The used die material was conventional tool steel. During ejection of the compacted samples, the static and dynamic ejection forces were measured, and the total ejection energy needed in order to eject the samples from the die were calculated. The following table 5 shows ejection forces, ejection energy, green density, the surface appearance and the overall performance for the different samples.

TABLE 5

| | Lubricant | | | | | |
|---|---|---|---|---|---|---|
| | A | B | C | D | E | F |
| Ejection energy ($J/cm^2$) | 101 | 156 | 79 | 76 | 208 | 96 |
| Stat. Ej. force (kN) | 46 | 58 | 35 | 27 | 53 | 27 |
| Dyn. Ej. force (kN) | 40 | 63 | 29 | 27 | 97 | 33 |
| Surface appearance | Slightly scratched | Scratched | Perfect | Perfect | Seizure | Slightly scratched |
| Green density ($g/cm^3$) | 7.70 | 7.68 | 7.69 | 7.68 | 7.69 | 7.69 |
| Overall performance | Acceptable | Not acceptable | Good | Good | Not acceptable | Acceptable |

EXAMPLE 2

A powder mix containing lubricant C was prepared according to example 1, and cylindrical test samples according to example 1 were compacted at five different temperatures of the die. The following table 6 shows the ejection forces and ejection energy needed to eject the test samples from the die, the surface appearance of the ejected samples, and the green density of the samples.

TABLE 6

| Lubricant C 1100 MPa; 0.20 wt. % | Ejection engergy ($J/cm^2$) | Stat Ej. force (kN) | Dyn. Ej force (kN) | Surface appearance | Green density ($g/cm^3$) |
|---|---|---|---|---|---|
| RT | 79 | 35 | 29 | Perfect | 7.69 |
| 40° C. | 77 | 32 | 26 | Perfect | 7.70 |
| 60° C. | 74 | 31 | 26 | Perfect | 7.70 |

TABLE 6-continued

| Lubricant C 1100 MPa; 0.20 wt. % | Ejection engergy ($J/cm^2$) | Stat Ej. force (kN) | Dyn. Ej force (kN) | Surface appearance | Green density ($g/cm^3$) |
|---|---|---|---|---|---|
| 80° C. | 73 | 36 | 25 | Perfect | 7.70 |
| 100° C. | 80 | 41 | 29 | Slightly scratched | 7.70 |

From the table above it can be concluded that excellent ejection properties can be obtained below a die temperature of 80° C.

EXAMPLE 3

This example illustrates the influence of added amount of lubricant C on the ejection force and ejection energy needed in order to eject the compacted sample from the die as well as the surface appearances of the ejected samples. The mixes were prepared according to example 1 with the exception that the lubricant levels of 0.05%, 0.10%, and 0.40% were added. Samples according to example 1 were compacted at room temperature (RT). The following table 7 shows the energy needed in order to eject the samples from the die as well as the surface appearances of the ejected sample.

TABLE 7

| Lubricant C 1000 MPa; RT | Ej. Energy ($J/cm^2$) | Surface appearance | Green density ($g/cm^3$) |
|---|---|---|---|
| 0.05% | 197 | Seizure | 7.71 |
| 0.10% | 151 | Scratched | 7.70 |
| 0.20% | 79 | Perfect | 7.69 |
| 0.40% | 76 | Perfect | 7.58 |

From table 7 it is shown that a content of at least 0.10% of lubricant C is needed for this compaction pressure in order to get acceptable ejection behaviour from the die. Furthermore, the type of component geometry and tool material are also expected to have influence on ejection.

EXAMPLE 4

This example illustrate the influence of the particle size distribution on the ejection force and ejection energy needed in order to eject the samples from the die and the influence of the particle size distribution on the surface appearance of the ejected sample when using liquid lubricants according to the invention. Example 1 was repeated with the exception of that a "fine powder" was used in comparison to coarse powder (Table 4).

The following table 8 shows the ejection force and energy needed in order to eject the samples from the die as well as the surface appearances of the ejected sample.

TABLE 8

| | Lubricant C (0.20 wt. %) | |
|---|---|---|
| 1100 MPa; RT | Coarse powder | Fine powder |
| Ej. energy (J/cm$^2$) | 79 | 142 |
| Stat. Ej. force (kN) | 35 | 36 |
| Dyn. Ej. force (kN) | 29 | 57 |
| Surface appearance | Perfect | Slightly scratched |
| Green density (g/cm$^3$) | 7.69 | 7.67 |
| Overall performance | Good | Acceptable |

Conventional particulate lubricating systems such as Kenolube® generally need higher amounts of lubricant (>0.5 wt %) to reach similar lubricating performance. At such high amounts of added lubricant, compaction pressures above 800 MPa do not result in improved magnetic properties as further improvements in density levels cannot be obtained (reference sample G).

Six mixes were prepared according to example 1. The obtained mixes were transferred to a die and compacted into 55/45 mm toroids, with a height of 5 mm, in a uniaxially press movement at a compaction pressure of 1100 MPa. The samples were heat-treated in air at 530° C. for 30 min. The magnetic properties were measured on the toroids samples with 100 drive and 100 sense turns using a Brockhaus hysteresisgraph. The following table 9 shows the electrical resistivity as measured by the four-point method, maximal permeability, the induction level at 10 kA/m, as well as the core losses at 1 T 400 Hz, and 1 kHz, respectively.

TABLE 9

| Lubricant 0.20 wt. % | Lubricating Performance | Density (g/cm3) | Resistivity (μOhm · m) | Maximal Permeability | B@10 kA/m (T) | Loss@1T 400 Hz (W/kg) |
|---|---|---|---|---|---|---|
| A | Acceptable | 7.67 | 60 | 867 | 1.71 | 41 |
| B* | Unacceptable | 7.67 | 45 | 926 | 1.71 | 42 |
| C | Excellent | 7.68 | 170 | 703 | 1.69 | 39 |
| D | Good | 7.68 | 85 | 756 | 1.69 | 40 |
| E* | Seizure | — | — | — | — | — |
| F | Acceptable | 7.64 | 27 | 934 | 1.72 | 47 |
| G** | Good | 7.50 | 300 | 580 | 1.58 | 44 |

*not according to the invention.
**Reference sample G is coarse powder mixed with 0.5% Kenolube ®.

From the table above it can be seen that compositions including the type of liquid lubricants defined above can be used on both fine and coarse soft magnetic powder. However, when coarse powders are used, both the surface finish and the green density of the compacted part are improved. Moreover, powder properties, such as apparent density and flow, of fine powders are usually poor using liquid lubricants according to the invention. Nevertheless, for applications without high requirements on these powder properties fine powders can provide components of acceptable quality using the liquid lubricants according to the invention.

EXAMPLE 5

This example illustrates the excellent magnetic properties obtained using low contents of liquid lubricants according to the invention. In general, less lubricating properties will result in decreased electrical resistivity and increased core loss. However, this example shows that even when the lubricating performance is unacceptable, magnetic properties such as maximum permeability can be acceptable (sample B). Such lubricants, that show unacceptable lubricating performance, cannot however be used in powders for large-scale production due to poor surface finish and excessive tool wear.

The invention claimed is:

1. A coarse powder composition for compaction containing an iron or iron-based powder, wherein the particles are surrounded by an insulating inorganic coating and less than 10% by weight of the powder particles have a size below 45 μm, and as lubricant at least one nondrying oil or liquid having a crystalline melting point below 25° C., a viscosity (η) at 40° C. above 15 mPa·s, wherein said viscosity is temperature dependent according to the following formula:

$$lg(\eta)=k/T+C,$$

wherein the slope k is above 800 (T is in Kelvin and C is a constant), in an amount between 0.05 and 0.40% by weight of the composition.

2. The powder composition as claimed in claim 1 wherein the lubricant is selected from the group consisting of mineral oils, vegetable or animal based fatty acids, polyethylene glycols, polypropylene glycols, glycerine, and esterified derivates thereof, optionally in combination with additives.

3. The powder composition as claimed in claim 1, wherein the lubricant is included in an amount of 0.1-0.3% by weight.

4. The powder composition as claimed in claim 3, which is free from lubricant(s), which is (are) solid at ambient temperature.

5. The powder composition as claimed in claim 1, wherein less than about 5% by weight of the powder particles have a size below 45 μm.

6. The powder composition according to claim 5, wherein at least 40% by weight of the iron based powder consists of particles having a particle size above about 106 μm.

7. The powder composition according to claim 5, wherein at least 20% by weight of the iron based powder consists of particles having a particle size above about 212 μm.

8. The powder composition as claimed in claim 1, further containing one or more additives selected from the group consisting of organic binders and resins, flow-enhancing agents, processing aids and particulate lubricants.

9. A method for making heat-treated soft magnetic components comprising the steps of:

a) mixing a coarse soft magnetic iron or iron-based powder, wherein the particles are surrounded by an inorganic insulating layer and less than 10% by weight of the powder particles have a size below 45 μm, and as a lubricant a non-drying oil or liquid, which has a crystalline melting point below 25° C. a viscosity (η) at 40° C. above 15 mPa·s and wherein said viscosity is temperature dependent according to the following formula:

$$lg(\eta)=k/T+C$$

wherein the slope k is above 800

T is in Kelvin and

C is a constant in an amount between 0.05 and 0.4% by weight of the composition and, b) compacting the composition to a compacted body at a pressure above about 600 MPa.

10. The powder composition as claimed in claim 2 wherein at least one additive is present and selected from the group consisting of rheological modifiers, extreme pressure additives, anti cold welding additives, oxidation inhibitors and rust inhibitors.

11. The powder composition as claimed in claim 1, wherein the lubricant is included in an amount of 0.15-0.25% by weight.

12. The powder composition according to claim 5, wherein at least 60% by weight of the iron based powder consists of particles having a particle size above about 106 μm.

13. The powder composition according to claim 5, wherein at least 40% by weight of the iron based powder consists of particles having a particle size above about 212 μm.

14. The powder composition according to claim 5, wherein at least 50% by weight of the iron based powder consists of particles having a particle size above about 212 μm.

* * * * *